United States Patent [19]

Takashima et al.

[11] 3,971,655

[45] July 27, 1976

[54] METHOD FOR TREATMENT OF MOLTEN STEEL IN A LADLE

[75] Inventors: Kiyoshi Takashima; Keizi Arima; Takeshi Shozi, all of Sakai; Hisashi Mori, Kitakyushu, all of Japan

[73] Assignee: Nippon Steel Corporation, Tokyo, Japan

[22] Filed: Aug. 21, 1974

[21] Appl. No.: 499,162

[52] U.S. Cl. ..... 75/59; 75/60; 75/93 E

[51] Int. Cl.[2] ..... C21C 5/34

[58] Field of Search ..... 75/59, 60, 93

[56] References Cited

UNITED STATES PATENTS

| | | | |
|---|---|---|---|
| 3,268,326 | 8/1966 | Harders | 75/49 |
| 3,320,053 | 5/1967 | Lehman | 75/59 |
| 3,396,777 | 8/1966 | Reding | 75/65 |
| 3,820,767 | 6/1974 | Metz | 75/93 |

*Primary Examiner*—Peter D. Rosenberg
*Attorney, Agent, or Firm*—Toren, McGeady and Stanger

[57] ABSTRACT

Treatment of molten steel in a ladle, which comprises blowing inert gas into the ladle from its bottom, partially immersing a receptacle which covers the portion of the molten steel where the inert gas bubbles out and maintain non-oxidizing atmospheres within the receptacle with the gas so as to prevent oxidation of the molten steel by the slag.

6 Claims, 15 Drawing Figures

METHOD FOR TREATMENT OF MOLTEN STEEL IN A LADLE

The present invention relates to a method and apparatus for treatment of molten steel in a ladle, and more particularly, a method for refining molten steel in a ladle by blowing gas thereinto and a method for adding alloying elements into the molten steel and an apparatus therefore.

As for the method for ladle refining of molten steel, gas blowing, vacuum treatment, magnetic stirring, etc., have been conventionally practised. The ladle refining by gas blowing has advantages in that its capital cost is low and it gives good working efficiency and thus has been more widely used as compared with other methods, and various improvements have been made.

In general, the amount of gas to be blown into a ladle required for floating-up and separation of impurities has been 0.02 to 0.2 $m^2/T$, but under the presence of a slag containing iron, such as, steel-making slag, this amount causes oxidation of the molten steel and remarkably lowers the steel cleaning effect. In order to avoid the oxidation, a gas-blowing method using a non-oxidizing slag has been developed, but in case of the addition of a non-oxidizing slag, it is a prerequisit that the flowing of the oxidizing slag into the ladle from a steel-making furnace must be prevented. This would require tremendous cost.

Even if the means for the non-oxidizing slag is solved, when the amount of blown gas is increased, the surface of the molten steel is exposed to the air, and thus subjected to air oxidation. Therefore, it is necessary to restrict the gas blowing within a range which does not expose the molten steel surface to the air, and this necessarily restricts the bath stirring and elongates the treating time.

Therefore, one of the objects of the present invention is to provide a method for gas-blown refining of molten steel in a ladle which overcomes the defects and problems encountered by the conventional gas-blown refining methods and which permits an increased amount of blown gas to increase the stirring of the molten steel in the ladle thereby enhancing the refining efficiency of the molten steel and shortening the treating time. In order to attain this object, the present invention comprises inserting a receptacle or a cover which covers a portion of the molten steel surface in a ladle where gas bubbles out to keep the atmosphere in the receptacle in a non-oxidizing condition by means of the bubbling gas and to prevent oxidation of the molten steel by the air and the slag, and separating impurities from the molten steel.

Meanwhile, generally severe standards have been adopted for steel compositions for specific applications because they have a decisive influence on the steel material qualities, and in the case of a rimmed steel, it is well known that they have decisive influence on the surface nature and internal quality of the steel.

Therefore, it has been one of the most important technical problems to severely control the chemical composition of the molten steel in a ladle.

As for the conventional arts for solving this technical problem, a method has been proposed in which the addition of ferro-alloys is charged in correspondence to the total oxygen content or the free oxygen content in the molten steel in the ladle, or a method has been proposed in which the composition is adjusted precisely by adding alloying elements into the vacuum degassing tank and argon gas is introduced into the ladle to cause bubbling and an aluminum wire is also supplied to precisely adjust the aluminum content.

However, a satisfactory method or apparatus has not yet been developed which can adjust all of the alloying elements, such as, C, Si and Mn, precisely to the desired contents simultaneously at low costs.

Particularly, elements, such as, C and Si or their alloys, have a lighter specific gravity than the molten steel, they float up on the molten steel if they are added simply and are hardly dissolved into the molten steel bath, and further they are consumed by the slag floating on the molten steel, resulting in a considerably lowered yield. These problems have hampered practical operations of the treatment.

Meanwhile, in the case of some killed steels, a low nitrogen content is required.

Therefore, it is desirable to reduce the addition into the ladle during tapping of strong deoxidizing agents, such as, Ti, Al and Si and to add these agents into the ladle after tapping in a substantially shielded state from the air, because it is well known that absorption of nitrogen and hydrogen into the molten steel due to the reaction between the molten steel and the air during tapping is reduced as the amount of the oxygen dissolved in the molten steel increases.

The present invention has been made on the basis of the above facts, and the features of the present invention lie in that a cylindrical member opening at its lower end and having a hole for adding alloying elements therethrough is placed on the surface of the molten steel at a position where inert gas blown from the ladle bottom bubbles up, and the alloying elements are added into the cylindrical member through the hole while the cylindrical member is partially immersed in the molten steel preventing the slag from flowing into the cylindrical member.

The present invention will be described in detail referring to the attached drawings.

Figure 1:
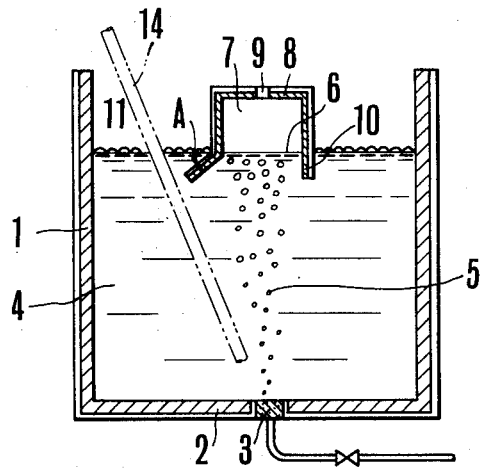
FIG. 1 shows a schematic view of an apparatus used for the gas blowing into the molten steel in the ladle according to the present invention.

In FIG. 1 is a ladle which receives molten steel, provided with a porous plug 3 at its bottom 2. Inert gas, such as, argon gas and nitrogen gas is blown into the molten steel 4 through the porous plug 3, and forms gas bubbles 5 which float up in the molten steel bath and come out the bath from the steel bath surface 6. 7 is a receptacle which is partially immersed in the molten steel bath so as to separates the portion of the bath surface 6 where the gas bubble up from the other portions of the molten steel surface in the ladle.

This separation receptacle 7 is usually formed in a cylindrical shape, and its upper portion 7 is covered by a coiling plate 8 provided with a small hole 9, and its lower opening portion is immersed in the molten steel bath 4 as shown. The diameter of this receptacle 7 must be large enough to cover wholly the portion of the molten steel surface where the gas bubbles floating up through the bath, but on the other hand it is desirable that the diameter is small enough to prevent the slag 11 from coming into the receptacle. According to the results of experiments by the present inventors, satisfactory results can be obtained with a receptacle diameter corresponding to 1/20 to 4/3, preferably 1/5 to ⅓ of the inside diameter of the ladle 1. Also regarding the height of the receptacle 7, it must be high enough to prevent deposition of metal on the inside wall of the receptacle due to splashing of the metal during the stirring. The lower portion of the receptacle 7 which is to be immersed in the molten steel bath 4 is prepared by brick workings or applied with a powder refractory agent.

Figure 2:
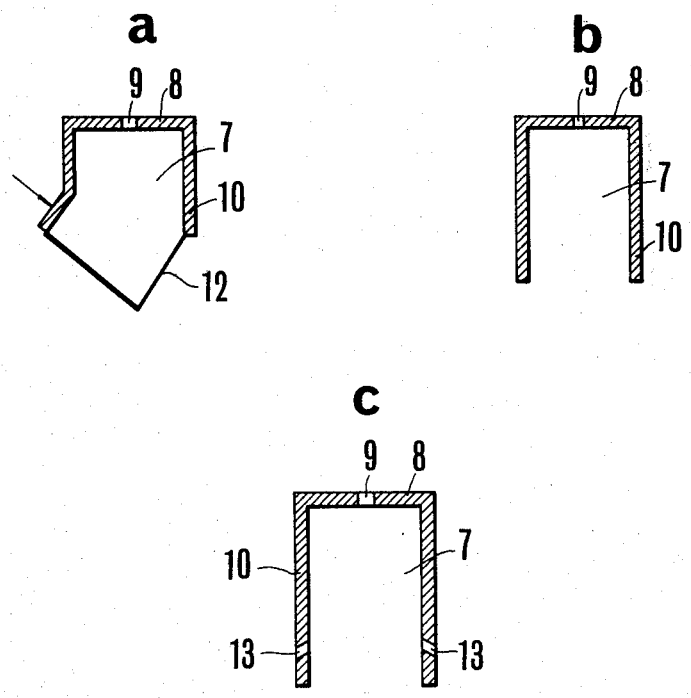
FIG. 2 shows some embodiments of the receptacles used in the present invention.

Regarding the wall 10 of the receptacle 7, various shapes may be used and some embodiments are shown in FIG. 2.

When the part of the wall 10 is widen on one side as shown in FIG. 1, the movement of the molten steel bath surface separated by the receptacle 7 is reduced, and the stirring of molten steel can be effectively done.

In case of the receptacle shown in FIG. 2*a*, the cone portion 12 contributes to prevent the slag on the bath surface from coming into the receptacle, and faciliates deposition of non-oxidizing slag within the receptacle. The receptacle shown in FIG. 2*b* has a straight cross-section of the wall 10 and the receptacle shown in FIG. 2*c* has an inlet 13 around the wall 10.

For actual practice of the gas-blown refining of the molten steel in a ladle according to the present invention, when inert gas such as argon gas and nitrogen gas is blown into the molten steel in the ladle through the porous plug 3 or a gas blowing lance 14, the gas forms bubbles in the molten steel 4 and these bubbles float up stirring the molten steel and fills the space within the receptacle 7 and finally get out through the hole 9. Therefore, the space within the receptacle is maintained under an inert atmosphere with the inert gas bubbling up so that even if the surface of the molten steel is exposed by the severe stirring caused by the floating gas bubbles, the molten steel is not subjected to reoxidization. Thus it is possible to blow a large amount of gas into the molten steel to cause strong stirring in order to enhance removal of non-metallic inclusions and shorten the treating time.

Meanwhile, non-oxidizing synthetic slag may be deposited within the receptacle beforehand, or an opening may be provided in the receptacle for introducing, non-oxidizing slag into the molten steel at the time of necessity.

Figure 3:
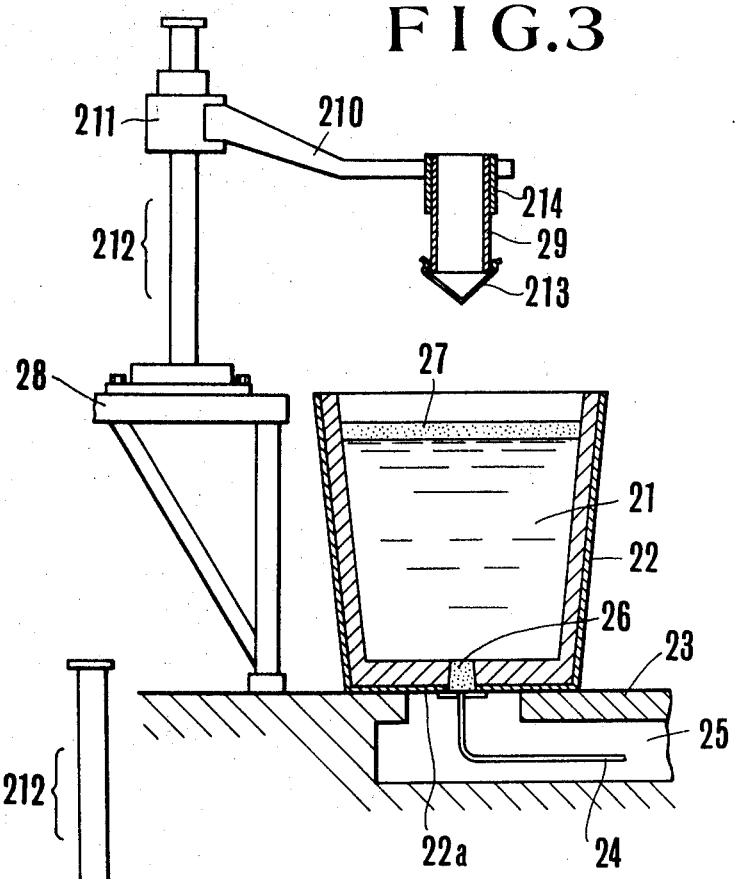
FIG. 3 shows a modification of the embodiment shown in FIG. 1.
Figure 4:
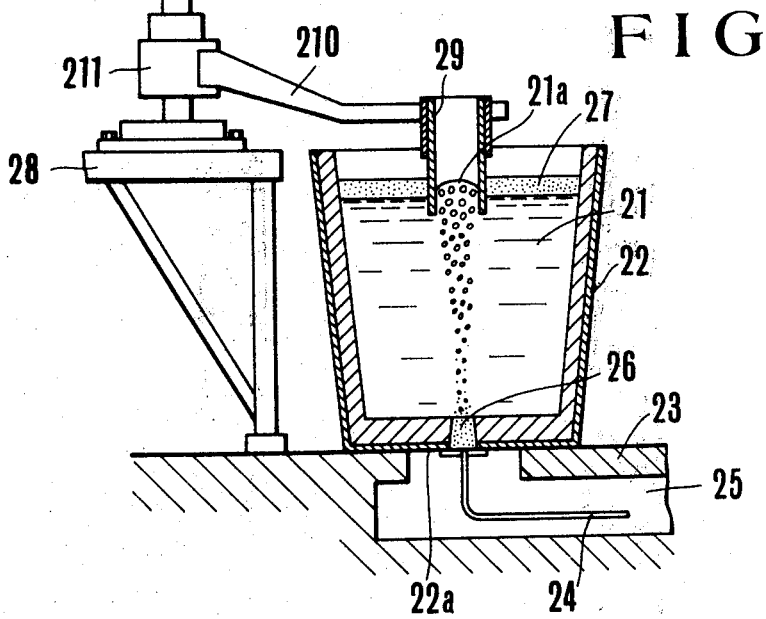
FIG. 4 shows the operation of the modified embodiment shown in FIG. 3.

A modification of the apparatus used for refining the molten steel in the ladle according to the present invention will be described referring to FIG. 3 to FIG. 5.

In this modification, an operation floor 28 is provided near the ladle 22, a lifting mechanism 212 which holds and moves up and down a holder 211 having an arm 210 which holds a refractory cylindrical receptacle 29 is arranged on the operation floor 28, and at the top portion of the cylindrical receptacle 29, there is attached an umbrella-like slag breaker 213 which is very effective to prevent the slag from coming into the receptacle. This slag breaker 213 is made of thin steel sheet and is immediately melted into the molten steel when it is immersed therein.

The depth of the receptacle to be immersed in the molten steel is desirably from 100 to 400 mm, but should be chosen depending on the operation conditions and requirements of the equipment, namely, the depth of the molten steel bath, the diameter, length and shape of the receptacle 29, the rate of gas blowing, the quality of molten steel and the depth of the slag layer. Further the receptacle may be reinforced with a steel plate 214 on its outside to improve its mechanical strength and life.

Figure 5:
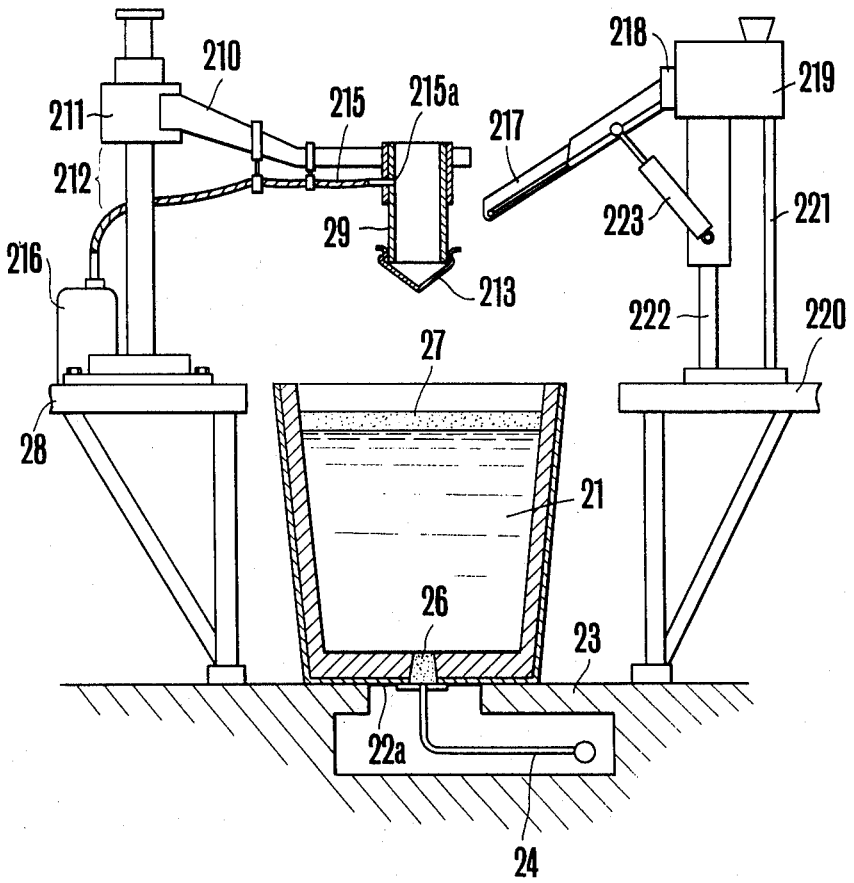
FIG. 5 shows a further modification of the embodiment shown in FIG. 1.

In FIG. 5, an inert gas supplying pipe 215 is connected to the receptacle 29, and the inert gas such as argon gas and nitrogen gas from the inert gas supply source 216, for example a tank, is blown into the receptacle 29 to fill the space within the receptacle with the gas and then or during the gas blowing, the receptacle 29 is put into the molten steel 21 so as to keep the exposed surface of the molten steel from direct contact with the air, thus preventing reoxidization of the molten steel and improving the cleaning effect of the steel. The inert gas supply pipe 215 may be made of flexible pipe so as to facilitate handling of the receptacle into the molten steel while the gas is blown.

After the lower portion of the receptacle is immersed in the molten steel 21, the supply of the inert gas may be stopped because the gas floating up through the molten steel comes into the receptacle 29, or the supply may be continued.

In the present invention, the inert gas is blown into the upper portion of the receptacle because if the opening 215*a* of the supply pipe 215 contacts the slag layer 27 or the molten steel 21, it is melted or clogged. So far as this danger can be avoided any gas blowing means may be adopted within the scope of the present invention.

Reoxidation of the molten steel by the air can be more effectively prevented when non-oxidizing slag composed mainly of CaO, $SiO_2$, $Al_2O_3$, $CaF_2$, etc., is placed beforehand within the receptacle attached with the slag breaker 213 in an amount enough to cover the exposed surface 21*a* of the molten steel and then the receptacle 29 is put into the molten steel. In this case the inert gas may be blown simultaneously.

Regarding the supply of the non-oxidizing slag, the operation can be facilitated if a hopper 219 having an expandable chute 217 and a charging device 218 is mounted on the operation floor 221 by means of the supports 221 and 222 so as to supply the slag into the receptacle through the hopper. Further, when the chute 217 is designed to tilt up and down by a hydraulic or air cylinder 223, the operation time can be further shortened.

Figures 6, 7, 8:
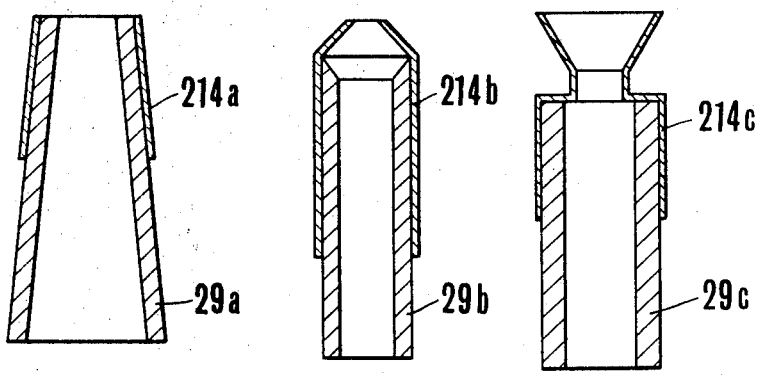
FIGS. 6–8 show, respectively, an example of the cylindrical members used in the embodiments shown in FIGS. 3 and 5.

Regarding the shape or structure of the receptacle 29, it may be of various forms and structures as shown in FIG. 6 to FIG. 8. In the drawings, 29*a* is a refractory cylindrical receptacle, and 214*a*, 214*b* and 214*c* are each, respectively, a steel skin. Heat-resistance lining may be applied, if necessary, to elongate the life of the receptacle.

Examples of the gas-blown refinement of molten steel in a ladle according to the present invention will be set forth under in connection with removal of non-metallic inclusions.

Example 1

| | |
|---|---|
| Amount of molten steel in a ladle: | 185 tons |
| Inside diameter of the ladle: | 3600 mm |
| Shape and size of the receptacle: | |
| Inside diameter: | 1200 mm |
| Height: | 2000 mm |
| Structure: Outside: | Steel sheet lining |
| Inside: | Brick lining at upper portion. Castable lining lower portion 600 mm from bottom. Thickness: 200 mm |
| Gas opening inside diameter: 100 mm | |
| A cone portion made of steel plate was attached to the lower portion of the wall, and 200 kg of non-oxidizing synthetic slag was placed therein. | |
| The depth of immersion in the molten steel: 400 mm | |
| Inert gas blown | |
| Kind: | argon gas |
| Blow rate: | 600 l/min. |
| Blowing time: | 10 min./ch |

The analysis of the atmosphere within the receptacle one minute after the gas blowing start is shown in Table 1.

Table 1

| $O_2$ | $CO_2$ | CO | $H_2$ | $Ar+N_2$ |
|---|---|---|---|---|
| 0.3% | 1.2% | 17.2% | 0 | 81.3% |

Figure 9:
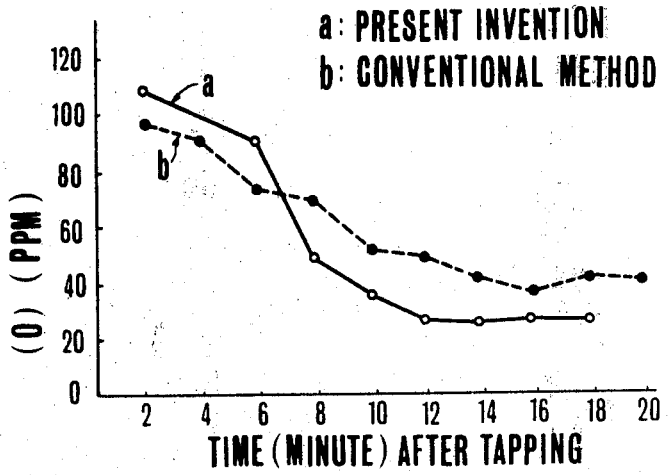
FIG. 9 is a graph showing results obtained by the present invention.

FIG. 9 shows the analysis of oxygen in samples taken from the molten steel under treatment, *a* represents the steel treated by the present invention, and *b* represents a comparative steel treated in the ladle.

The oxygen lowers only gradually, and the final [0] value is 40 ppm in the comparative steel, while the [0] value lowers sharply and the final [0] value is 25 ppm in the steel of the present invention. The lowering rate of the molten steel temperature in the treatment according to the present invention was about 30°C/10 minutes.

According to the results of analysis of the slag taken from the receptacle at the end of the stirring treatment by the argon gas blowing, FeO in the slag was not more than 2%, the slag in the receptacle was non-oxidizing and did not cause reoxidation of the molten steel bath.

The steel treated according to the present invention was rolled into electroseamed pipes. These pipes were subjected to ultrasonic testing to detect defects due to non-metallic inclusions, and the rejection rate was less than 2%, as compared with 5 – 10% in case of similar pipes made from the comparative steel.

Figure 10:
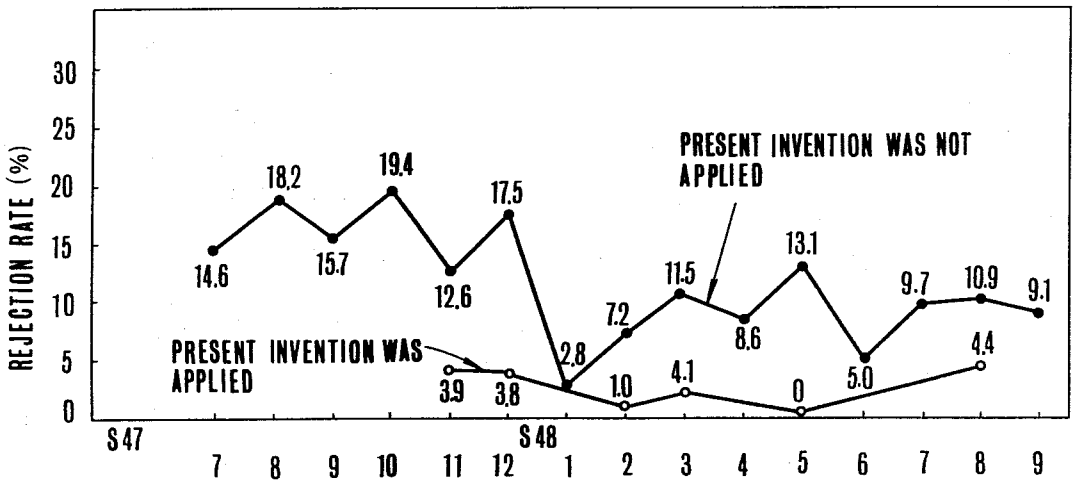
FIG. 10 is a graph showing results obtained by the embodiments shown in FIGS. 3 and 5.

FIG. 10 shows comparision between the rejection ratio due to large non-metallic inclusions of the steels treated by the present invention and that of the steels not treated by the present invention.

Table 2 shows the occurrence of flows in the case when the present invention was applied to low-carbon Al-killed steels which are widely used and require clean surface and internal conditions in comparison with the case when the present invention was not applied (Namely the molten steel is poured from bottom directly from the ladle or the steel is received in the ladle and given a long enough time for killing).

Table 2

| | Number of flows of 0.5–2mm per/100 cm² | Number of flows beyond 2mm per/100 cm² | Total length of (mm/100 cm²) |
|---|---|---|---|
| Treated by Present Invention | 1.6 | 0.2 | 2.4 |
| Not Treated by Present Invention | 3.6 | 1.3 | 11.3 |

As clearly understood from the above results, the flows beyond 0.5 mm are sharply reduced when the present invention is applied. Such sharp reduction of the flows even under the slag having a high oxygen potential demonstrates that the present invention is very effective for preventing reoxidation by the slag.

Figure 11:
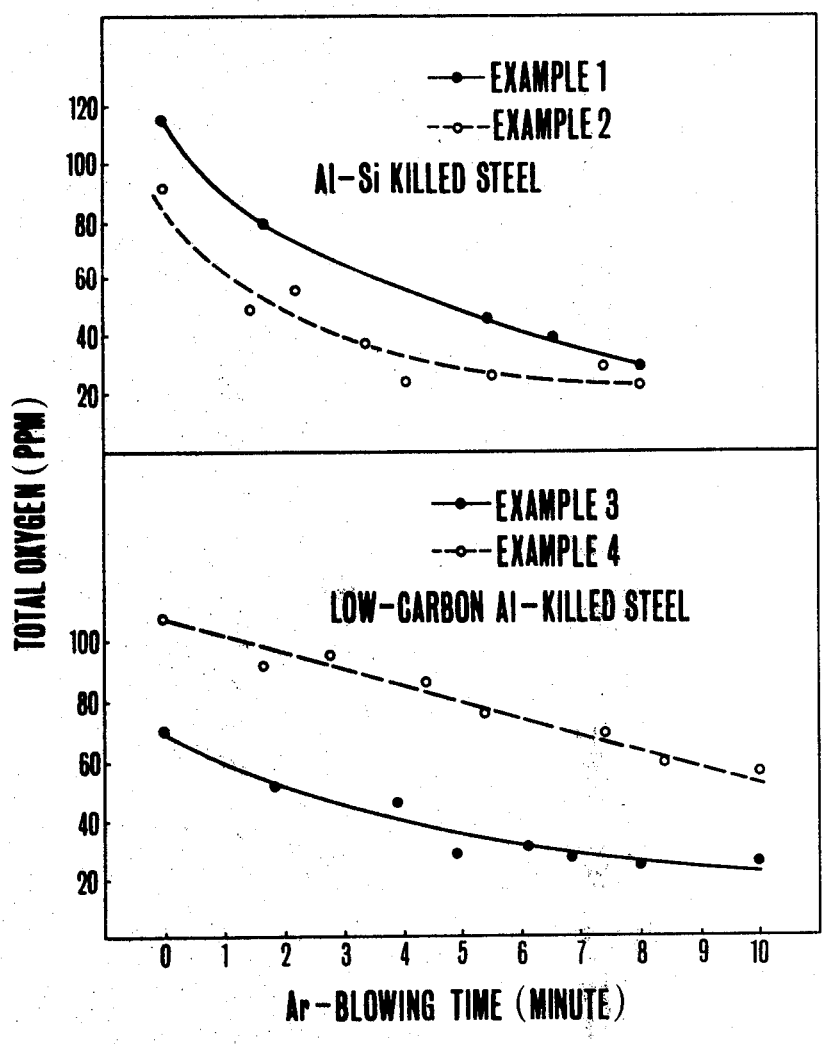
FIG. 11 is a graph showing changes in the oxygen content.
Figure 12:
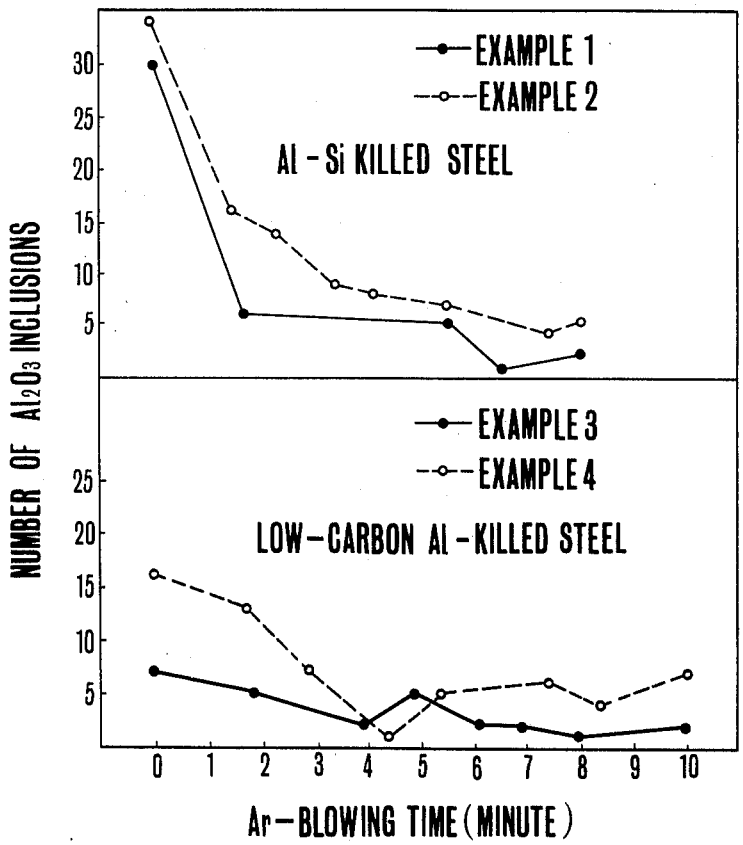
FIG. 12 is a graph showing changes in alumina inclusions along the lapse of time.

FIG. 11 shows changes in the total oxygen content along the lapse of time when some molten steels were treated according to the present invention, and FIG. 12 shows changes in alumina inclusions along the lapse of time.

As understood from FIG. 11 and 12, the present invention can easily provide a clean steel and steel products free from defects with a very simple method.

Further, with respect to the estimation of the reoxidation by the slag, in one example of the present invention, the decrease of sol.Al in the molten steel was 3 to $7 \times 10^{-3}$% as compared with 20 to $30 \times 10^{-3}$% obtained by a conventional method.

Figure 13:
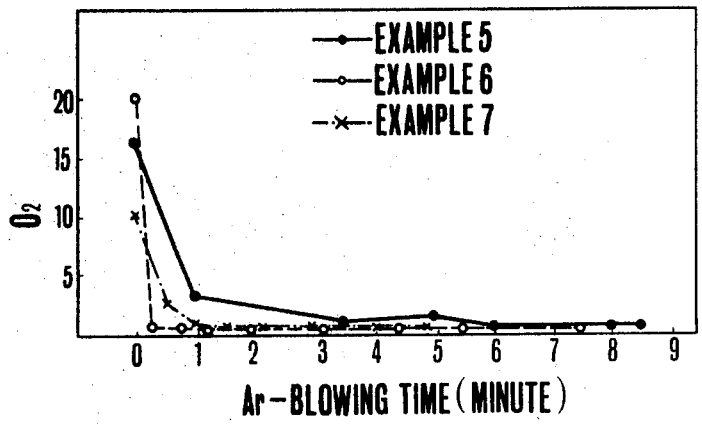
FIG. 13 is a graph showing changes in the oxygen concentration along the lapse of time.

FIG. 13 shows measurements of the oxygen concentration within the cylindrical receptacle 29*b* as shown in FIG. 7. As understood from the results that the oxygen concentrate was reduced to less than 1% one minute after the start of the gas blowing, the atmosphere over the exposed surface of the molten steel is kept under an inert condition.

As for means for cleaning steels, vacuum refining methods, such as, DH process and RH process have been known. The treatment according to the present invention requires only ⅓ to ¼ the treating cost as compared with these conventional methods and gives equally satisfactory results.

Next, some embodiments of the method and apparatus for adding alloying elements into the molten steel in a ladle according to the present invention in reference to FIGS. 14 and 15 will be discussed.

Figure 14:
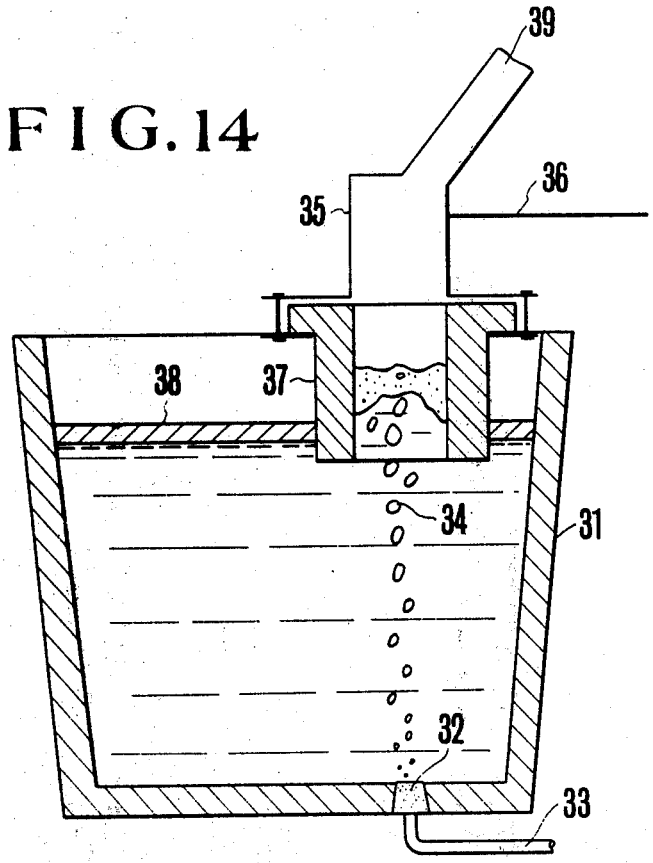
FIG. 14 shows one embodiment of the present invention for addition of alloying elements into the molten steel in the ladle.

In FIG. 14, 31 is a ladle provided with a porous plug 32 at its bottom. The inert gas is introduced into the ladle through the pipe 38 connected to the plug 32 and floats up as gas bubbles 34 in the molten steel. An alloy addition tank 35 is provided above the ladle and is connected to a lifting device for the tank by means of a holding arm 36. At the lower portion of the tank, a refractory cylindrical receptacle 37 made of refractory material is positioned and bolted thereto.

The functions and relative positions of the cylindrical receptacle 37 and the porous plug 32 are the same as in the preceding embodiments.

After the receptacle is partially immersed in the molten bath, alloy 10 is introduced from the alloy addition opening 39 and bubbling with inert gas is continued for a time long enough for full mixing of the alloy and the molten steel, and then the bubbling is stopped and the tank 35 is lifted upward.

In addition to the advantages obtained in the gas-blown refining of the molten steel in the ladle, the following advantages are obtained by the alloying method according to the present invention.

When pitch coke and alloys, such as, Fe-Si which have a lighter specific gravity than the molten steel are added, such alloys float on the surface of the molten steel become entangled by the slag and react with the slag, so that the yield of the alloys is low and varies largely in case of the conventional inert gas bubbling method. Whereas in the present invention, the yield of the alloys is very high and stable because the alloys added are separated from the slag.

Figure 15:
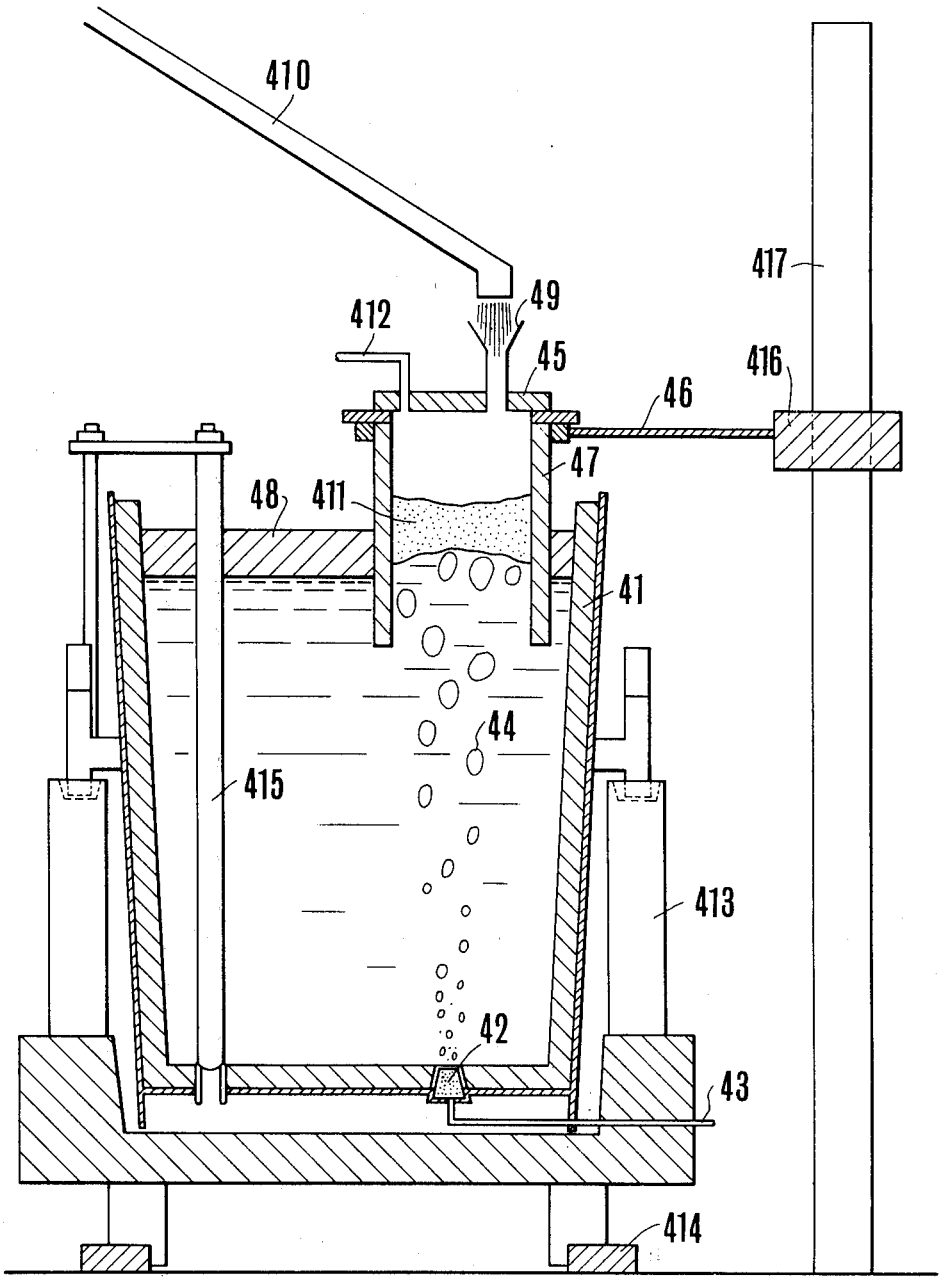
FIG. 15 shows a modification of the embodiment shown in FIG. 14.

FIG. 15 shows a modification of the apparatus shown in FIG. 14, in which 41 is a ladle, 42 is a porous plug, 43 is a pipe connected to the plug 42, 44 is gas bubbles, 45 is a lid for closing the ladle, which is connected to the left 46 by means of a holding arm 46. 47 is a cylindrical receptacle made of refractory material. 412 is a gas-flow inlet and 49 is an opening for alloy addition. 410 is a chute by which the alloy material 411 is supplied. 414 is a rail and 413 is a cart on which the ladle is mounted. The arm 416 is connected to the holding arm so as to be rotatable around the support 17 and movable up and down. 415 is a stopper.

This advantage will be more clearly understood from the following example.

For the production of Si-semikilled steel ingots, molten steel prepared in a 75 ton convertor was tapped into a ladle. During the tapping, alloy was added aiming to a ladle silicon content 0.01% less than the working standard before the argon was bubbling. After the tapping, samples were taken out from the molten steel in the ladle to conduct a rapid analysis for C, Si and Mn and the required Si content for obtaning the desired partial pressure value Pco and CO gas generation at the time of solidification was calculated from the actual measurement of 0 % and Mn %, and the difference between the aimed Si % and the actual Si % was added using the apparatus according to the present invention. In this way, the value of Pco could be controlled in a narrower range than conventionally so that the quality of the semikilled steel ingots could be improved.

For example, in the case of a steel grade containing 0.28 to 0.33% C, 1.10 to 1.30% Mn, the Pco for minimizing the loss of metal due to the tubular pin holes and pipes in the top portion of the ingot is known to be 0.80 atmospheric pressure from experience. The analysis of the molten steel after the tapping showed 0.31% C, 1.20% Mn and 0.038% Si in the above example, and it was seen that the desired Si % was 0.051% from the relation between the previously calculated Pco value and steel composition.

Then, in order to increase the Si content by 0.013% (0.051 − 0.038 = 0.013), Fe-Si was further added using the apparatus according to the present invention.

Table 3 shows the results of adjustments of steel compositions conducted on ten heats using the apparatus according to the present invention in comparison with those obtained by direct addition of the required additional alloy to the exposed surface of the molten steel during the argon gas bubbling, and by the conventional methods in which the adjustment is done during the argon gas bubbling or alloy is added at the time of tapping without using the apparatus of the present invention to obtain a final composition.

According to the present invention, the conformity to the Pco value could be improved and thus the loss of steel due to ingot defects was reduced.

Table 3

| | Pco of Ladle Molten Steel (at.press.) | | Loss due to slab defect caused by bubbles in top portions | Loss due to defects of products caused by pipes | Total loss |
|---|---|---|---|---|---|
| | Average | Normal variation | | | |
| Present Invention | 0.80 | 0.01 | 12 | 8 | 20 |
| Direct Addition during Ar bubbling | 0.79 | 0.03 | 25 | 19 | 44 |
| Conventional Method | 0.82 | 0.06 | 85 | 76 | 161 |

Descriptions will be made in connection with an example where the present apparatus is used for the adjustment of the steel composition for production of mechanical capped steel ingots. It is known that the most desirable composition for a steel grade containing 0.05 to 0.07% C, 0.15 – 0.20% Mn, and less than 0.015% S is 0.055% – 0.19% Mn — 0.013% S in view of the surface defects of the final products, defects detected by the ultrasonic detection. The molten steel (ten heats) was tapped to obtain an aimed composition somewhat lower than the above optinum composition and composition adjustment was done according to the present invention and a similar molten steel (ten heats) was adjusted in composition only by alloy addition at the time of tapping according to a conventional method. The results are shown in Table 4.

Table 4

| | Ladle Analysis | | | | | |
|---|---|---|---|---|---|---|
| | C % | | Mn % | | S % | |
| | Average | Nornal Variation | Average | Normal Variation | Average | Normal Variation |
| Present Invention | 0.056 | 0.002 | 0.19 | 0.005 | 0.013 | 0.001 |
| Conventional Method | 0.060 | 0.003 | 0.18 | 0.01 | 0.013 | 0.001 |

| | Loss due to Surface defects of production | Loss due to UST defects* of products | Total loss |
|---|---|---|---|

Table 4-continued

| | | | |
|---|---|---|---|
| Present Invention | 7 | 3 | 10 |
| Conventional Method | 10 | 50 | 60 |

*UST = Ultrasonic Test

Further, for production of a killed steel containing 0.13 to 0.15% C, 0.20 to 0.30% Si, 1.00 to 1.20 % Mn and 0.020 to 0.040% Al in a ladle, alloy addition was made by the following three methods.

1. Conventional method: The total amount of the alloy was added to the ladle during the tapping, and the argon gas bubbling was done for 2 to 15 minutes after the tapping.

2. Present invention (1): Alloy was added to the ladle to obtain the lower limits of the above final composition, and the deficient alloy, as determined by the check analysis of the ladle composition after the tapping, was added using the apparatus of the present invention.

3. Present invention (2): C and Mn were added during the tapping to attain their lower limits of the above final composition, Si and Al were added immediately after the tapping using the apparatus of the present invention to attain their lower limits of the above final composition, and then the deficient alloy as determined by the check analysis of the ladle composition was added using the apparatus of the present invention.

The results of the above alloy addition made to ten heats for each method are shown in Table 5.

Table 5

| | Normal Variation (%) of Components after Ar-gas Bubbling | | | | Absorption of N during period from end of blowing to end of Ar bubbling (ppm) |
|---|---|---|---|---|---|
| | C | Si | Mn | Al | |
| Conventional Method | 0.010 | 0.020 | 0.040 | 0.005 | 10 |
| Present Invention(1) | 0.005 | 0.010 | 0.021 | 0.003 | 4 |
| Present Invention(2) | 0.005 | 0.011 | 0.020 | 0.002 | 2 |

It is clear from Table 5 that variation of the ladle analysis is reduced remarkably and absorption of nitrogen during the period from the end of the blowing and the end of the argon gas blowing is reduced in the present invention.

What is claimed is:

1. In a method for refining a melt of molten steel by gas blowing in a ladle, said melt having a layer of slag on the surface thereof wherein an inert gas is bubbled upwardly from the bottom of the ladle through the melt to agitate and induce turbulence in the melt and remove impurities therefrom, said process being carried out under atmospheric pressure, the improvement which comprises partially immersing an inverted receptable having side walls into the surface of the melt such that a portion of the interior of the receptacle is above the surface of the melt and to create a slag-free melt surface within the side-walled area of the receptacle which is in contact with said interior portion, said side wall being immersed into the melt to a depth just sufficient to avoid the introduction of said slag into the interior portion due to turbulence of the melt and wherein the receptacle is positioned so as to entrap substantially all of the inert gas bubbles as they escape from the top of the melt and maintaining a non-oxidizing atmosphere within the interior portion of the receptacle.

2. The method of claim 1 wherein the receptacle possesses a slag breaker covering its open end, said slag breaker being composed of a disposable material which, once the receptacle is immersed through the slag layer into the melt, the slag breaker dissolves into the melt thereby exposing said slag-free surface of the melt to the interior portion of the receptacle.

3. The method of claim 1, wherein a gas selected from the group consisting of inert gases and non-oxidizing gases is introduced into the interior portion of the receptacle.

4. The method of claim 1 wherein a non-oxidizing slag is introduced into the interior portion of the receptacle.

5. The method of claim 1 wherein an alloy is added to the melt by introducing said alloy into the interior portion of the receptacle.

6. The method of claim 1 wherein an alloy is added to the melt in the ladle during tapping so as to attain the desired lower limits of said alloy in the final steel composition and wherein any alloy in which the melt is deficient is added to the melt by introducing said deficient alloy through the interior portion of the receptacle.

* * * * *